US008549810B1

(12) United States Patent
Norton et al.

(10) Patent No.: US 8,549,810 B1
(45) Date of Patent: Oct. 8, 2013

(54) CLIP FOR USE IN DROP CEILING SYSTEMS

(75) Inventors: Jack Norton, Bay Village, OH (US); Alberto Rodriguez, Avon, OH (US)

(73) Assignee: Norton Industries, Inc., Lakewood, OH (US)

( * ) Notice: Subject to any disclaimer, the term of this patent is extended or adjusted under 35 U.S.C. 154(b) by 0 days.

(21) Appl. No.: 13/465,072

(22) Filed: May 7, 2012

(51) Int. Cl.
*E04B 2/00* (2006.01)

(52) U.S. Cl.
USPC ..... 52/506.06; 52/506.07; 52/715

(58) Field of Classification Search
USPC ..... 52/506, 715, 712, 714, 39, 699, 506.06, 52/506.07, 506.08; 248/343
See application file for complete search history.

(56) References Cited

U.S. PATENT DOCUMENTS

| | | | | | |
|---|---|---|---|---|---|
| 1,662,539 | A | | 3/1928 | Schmidt | |
| 2,900,677 | A | | 8/1959 | Yetter | |
| 3,003,735 | A | | 10/1961 | Havener | |
| 3,018,080 | A | * | 1/1962 | Loudon | 248/228.4 |
| 3,251,164 | A | | 5/1966 | Wright | |
| 3,589,660 | A | | 6/1971 | Dunckel | |
| 3,612,461 | A | * | 10/1971 | Brown | 248/317 |
| 3,858,996 | A | | 1/1975 | Jarvis | |
| 4,191,352 | A | | 3/1980 | Schuplin | |
| 4,221,355 | A | * | 9/1980 | Hoop | 248/340 |
| 4,245,446 | A | | 1/1981 | Judkins | |
| 4,315,611 | A | | 2/1982 | Hoop | |
| 4,422,609 | A | * | 12/1983 | Clark | 248/228.1 |
| 4,439,973 | A | | 4/1984 | Nassof | |
| 4,525,971 | A | | 7/1985 | Kern | |
| 4,527,375 | A | * | 7/1985 | Braginetz | 52/712 |
| 4,541,216 | A | | 9/1985 | Head | |
| 4,838,002 | A | * | 6/1989 | Dajnko et al. | 52/475.1 |
| 4,890,428 | A | | 1/1990 | Platt | |
| 4,908,915 | A | | 3/1990 | Ruggles et al. | |
| 5,239,801 | A | | 8/1993 | Adams | |
| 5,368,265 | A | | 11/1994 | Gueli | |
| 5,399,044 | A | * | 3/1995 | Gilb | 403/231 |
| 5,609,007 | A | * | 3/1997 | Eichner | 52/747.1 |
| 5,692,346 | A | * | 12/1997 | Irvine et al. | 52/506.09 |
| 6,837,019 | B2 | * | 1/2005 | Collie | 52/712 |
| 7,010,895 | B2 | | 3/2006 | Bruno | |
| 7,478,506 | B2 | | 1/2009 | Wendt et al. | |
| 7,861,466 | B2 | * | 1/2011 | Sanborn | 52/39 |

* cited by examiner

*Primary Examiner* — Basil Katcheves
(74) *Attorney, Agent, or Firm* — Renner, Kenner, Greive, Bobak, Taylor & Weber

(57) ABSTRACT

A clip for attachment to a suspended ceiling grid support member, the clip including a generally planar body portion having a first edge, a second edge opposite the first edge, a first end, and a second end opposite the first end. A first wing is positioned at the first edge and at the first end and a second wing is positioned at the second edge and at the second end. The first wing has spaced aligned apertures located outside of the first edge and the second wing has spaced aligned apertures located outside of the second edge for receipt of fasteners therethrough. The fasteners extend into ceiling panels or planks without contacting the suspended support member to which the clips are secured.

20 Claims, 4 Drawing Sheets

CLIP FOR USE IN DROP CEILING SYSTEMS

TECHNICAL FIELD

This invention relates to a clip for use in drop ceiling systems. More particularly, this invention relates to such a ceiling clip that does not require fasteners to be driven through the supporting system of the drop ceiling during installation of a drop ceiling system.

BACKGROUND ART

Drop ceilings, which may also be referred to as dropped ceilings, false ceilings or suspended ceilings, are well known and are available in a variety of design options. Drop ceilings typically include a suspended grid having T-shaped support members hanging from wires attached to the plenum, and panels or planks secured to the grid. The popularity of drop ceilings is due, at least in part, to the visual and acoustic benefits coupled with the simplicity and ease of installation of the system.

The most common form of drop ceilings includes light weight panels, often square or rectangular in shape, that "drop" into a supporting T-grid without additional fastening mechanisms. These types of drop ceilings provide easy access to the plenum space above the ceiling for access to HVAC equipment, wiring, plumbing, and the like. However, many customers, both residential and commercial, view these types of ceilings as unattractive. Accordingly, there has been an increasing demand for more esthetically pleasing drop ceilings that may include planks of wood or composite materials with various decorative finishes. These planks may be more esthetically pleasing, but present installation difficulties not associated with the more common drop-in panels.

Known drop ceiling systems that utilize planks often require special supporting grids in order to suspend the planks. The specialized supporting grids may render the ceiling system more expensive and/or more complicated. Alternatively, the ceiling planks may be secured directly to a conventional support grid using fasteners. However, this attachment mechanism requires the grid to have holes in it for receipt of the fasteners and installation of the ceiling system is very labor intensive.

Thus, there is a need for an improved ceiling clip for attaching planks to a T-grid supporting system that alleviates one or more of the deficiencies of the prior art.

DISCLOSURE OF THE INVENTION

It is thus an object of one aspect of the present invention to provide a ceiling clip for use in drop ceiling systems that is easily connected to a support grid.

It is an object of another aspect of the present invention to provide a ceiling clip, as above, where ceiling panels or planks may be attached to the support grid without providing, holes in the grid system.

It is an object of a further aspect of the present invention to provide a drop ceiling including ceiling clips, as above, where the support grid and clips are concealed from view after installation.

These and other objects of the present invention, as well as the advantages thereof over existing prior art forms, which will become apparent from the description to follow, are accomplished by the improvements hereinafter described and claimed.

In general, a clip for attachment to a suspended ceiling grid support member includes a generally planar body portion having a first edge, a second edge opposite the first edge, a first end, and a second end opposite the first end. A first wing is positioned at the first edge and at the first end, and a second wing is positioned at the second edge and at the second end. The first wing has spaced aligned apertures located outside of the first edge, and the second wing has spaced aligned apertures located outside of the second edge.

In accordance with another aspect of the present invention, a ceiling clip includes a generally planar body portion having a first edge, a second edge opposite the first edge, a first end, and a second end opposite the first end. A first wing is positioned at the first edge and at the first end, and a second wing is positioned at the second edge and at the second end. The first and second wings each include a base portion generally coplanar with the body portion and extending outwardly therefrom, and a return portion connected to the base portion at an elbow and extending back toward the body portion at an acute angle relative to the base portion. The first wing has a hole in the base portion and an aligned slot in the return portion, the hole and the slot in the first wing located outside of the first edge. The second wing has a hole in the base portion and an aligned slot in the return portion, the hole and the slot in the second wing located outside of the second edge.

In accordance with another aspect of the present invention, a ceiling system includes support members having vertical columns and arms extending outwardly from a bottom edge of the vertical columns. The ceiling system also includes at least one clip secured to each of the support members, the clip including a generally planar body portion having a first edge, a second edge opposite the first edge, a first end, and a second end opposite the first end. A first wing is positioned at the first edge and at the first end, and a second wing is positioned at the second edge and at the second end. The first wing has spaced aligned apertures located outside of the first edge, and the second wing has spaced aligned apertures located outside of the second edge. The ceiling system further includes a ceiling plank, and fasteners extending through the apertures in the clips and into the ceiling plank to secure the plank to the support members. The fasteners are positioned adjacent the arms of the support members without passing through the arms.

A preferred exemplary ceiling clip according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
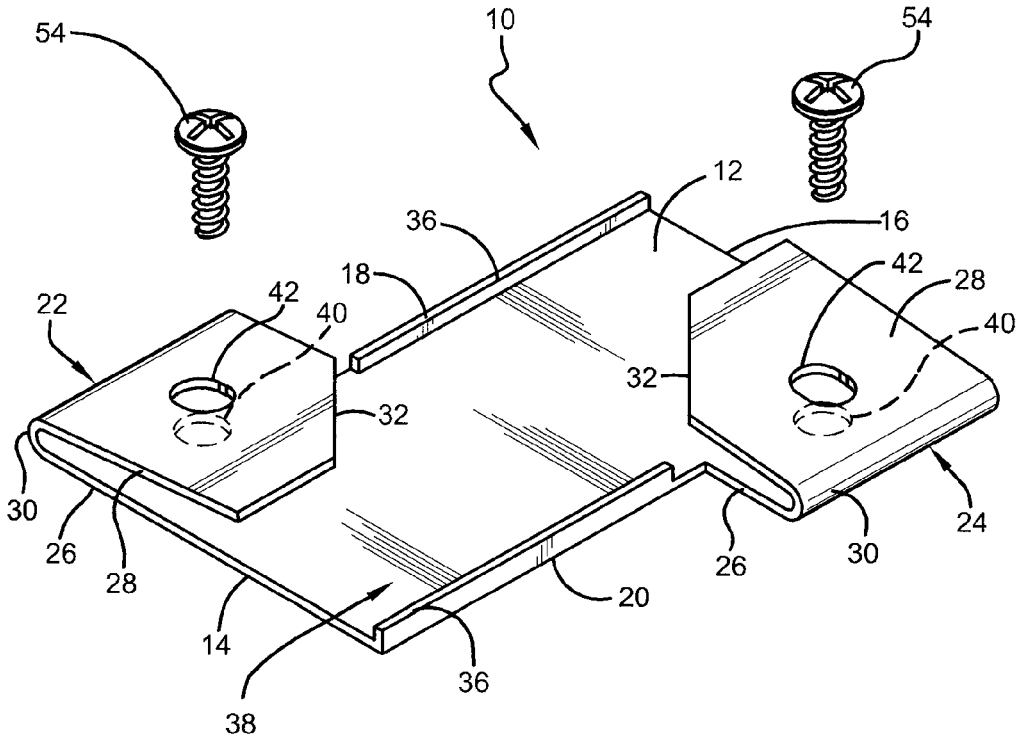
FIG. 1 is a perspective view of a ceiling clip for use in a drop ceiling according to the concepts of the present invention.

A ceiling clip made in accordance with the present invention is indicated generally by the numeral 10. Ceiling clip 10 is intended for use in a suspended ceiling system, or drop ceiling, but may have uses in other environments and applications. Ceiling clip 10 may be made of any suitable material known to those skilled in the art. In a particular embodiment, ceiling clip 10 may be made of resilient spring steel, which may optionally have a laminate coating.

Ceiling clip 10 includes a generally planer body portion 12 having a first end 14 and second end 16 opposite the first end. Body portion 12 also includes a first longitudinal edge 18 and a second longitudinal edge 20 opposite and generally parallel to the first longitudinal edge. A first wing generally indicated by the numeral 22 is positioned at the corner of the first longitudinal edge 18 and the first end 14. Similarly, a second wing generally indicated by the numeral 24 is positioned at the corner of the second longitudinal edge 20 and the second end 16. Thus, the first and second wings 22 and 24 are located at diagonally opposing edges and ends of the body portion 12.

Each wing 22, 24 includes a base portion 26 that is generally coplanar with body portion 12 and extends outwardly therefrom. The first wing 22 includes a base portion 26 that extends from the body portion 12 in a direction generally perpendicular to the first longitudinal edge 18. The second wing 24 includes a base portion 26 that extends from the body portion 12 in a direction generally perpendicular to the second longitudinal edge 20. Thus, the first and second wings 22, 24 are located at opposite ends 14, 16 of the body portion 12 and extend in opposite directions. Each wing 22, 24 also includes a return portion 28 connected to the base portion 26 at an elbow 30.

Figure 2:
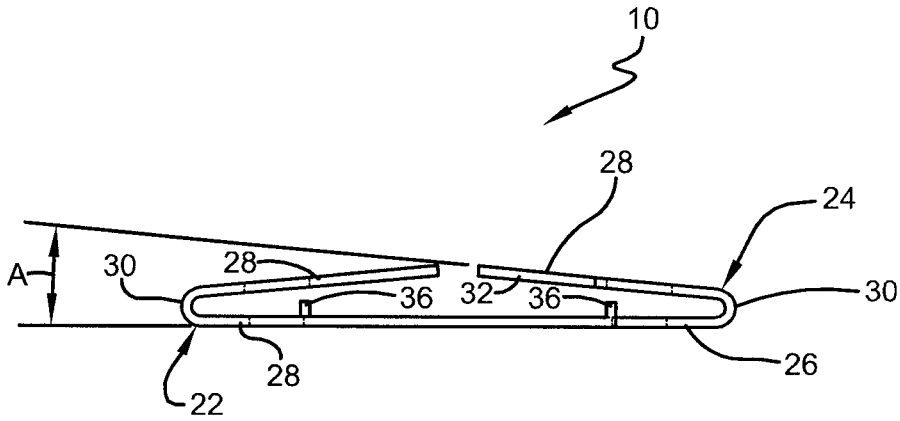
FIG. 2 is an end elevational view of the ceiling clip of FIG. 1.

Absent external forces acting on the first or second wings 22 and 24, the return portion 28 may be orientated at an acute angle A relative to the base portion 26 (FIG. 2). In certain embodiments, the angle between the return portion 28 and the base portion 26 may be between approximately 5° and 15°. The angle between the return portion 28 and the base portion 26 may facilitate positioning of the clip 10 on a support member of a T-grid system by providing a larger opening between the return portion 28 and the base portion 26 on an inner side of the wings 22 and 24.

Figure 3:
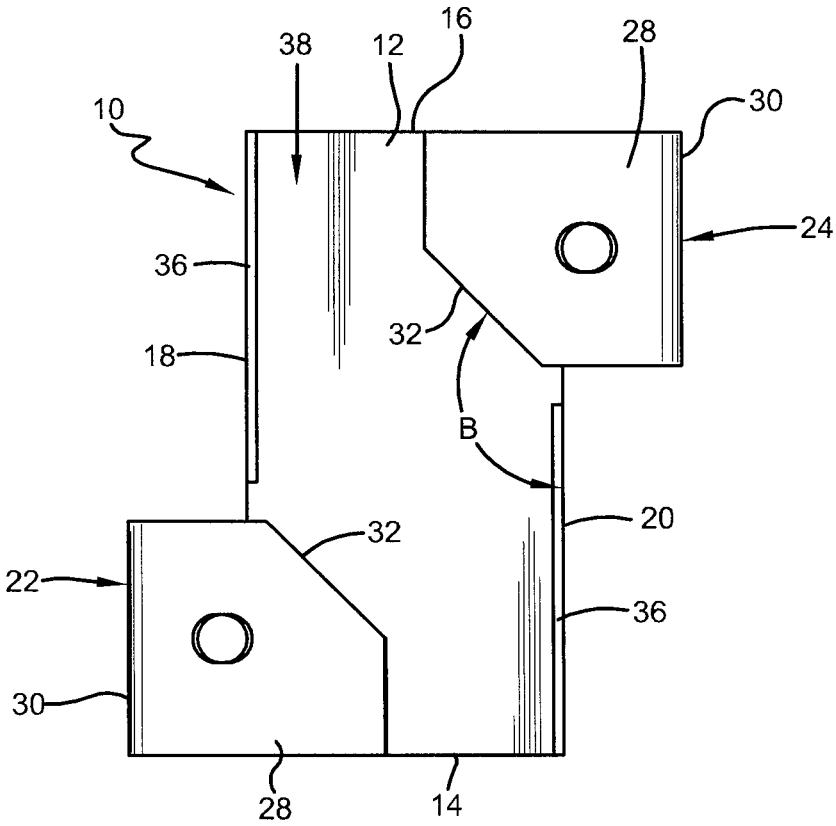
FIG. 3 is a top plan view of the ceiling clip of FIG. 1.

The return portions 28 of the first and second wings 22, 24 may include an angled edge 32 facing the interior of the body portion 12 to facilitate positioning of the clip on a T-grid. The angled edges 32 are angled relative to the longitudinal edges 18 and 20, and in certain embodiments may be oriented at an angle B relative to the longitudinal edges of approximately 45° (FIG. 3). The angled edges 32 of the first and second wings 22 and 24 may be oriented generally parallel to one another, with a distance therebetween that is greater than the combined width of opposing arms 48 and 50 of a support member 44 in a T-grid to allow insertion of the arms between the return portions 28, as will be hereinafter discussed in greater detail.

A rib 36 may extend upwardly from each of the first and second longitudinal edges 18 and 20 between the wing 22 or 24 and the opposite end 14 or 16. Thus, the rib 36 on the first longitudinal edge 18 extends from adjacent the wing 22 to the second end 16, and the rib 36 on the second longitudinal edge 20 extends from adjacent the wing 24 to the first end 14. The ribs 36 and body portion 12 together define a channel 38 extending the length of the clip 10.

Each base portion 26 of the first and second wings 22 and 24 includes an aperture or hole 40 extending therethrough. Similarly, the return portions 28 may also include an aperture 42 therethrough. In certain embodiments, the aperture in the return portions 28 of the first and second wings 22 and 24 may be in the form of a slot 42 that is generally axially aligned with the hole 40 of the base portion 26. The slot 42 may have a width that is approximately equal to the diameter of the hole 40, and a length that is a greater than the diameter of the hole 40. The length of the slot 42 is oriented generally parallel to the longitudinal direction of the return portion 28, which may also be referred to as generally perpendicular to the first and second edges 18 and 20. As will be appreciated by those skilled in the art, the greater length of the slot 42 allows a fastener to be inserted through the slot 42 and into the hole 40 in a direction generally perpendicular to the body portion 12 while the return portion 28 is oriented at an acute angle relative to the base portion 26. The slot 42 further allows deformation of the return portion 28 upon tightening of the fastener, as will be discussed below, without interference.

Figure 4:
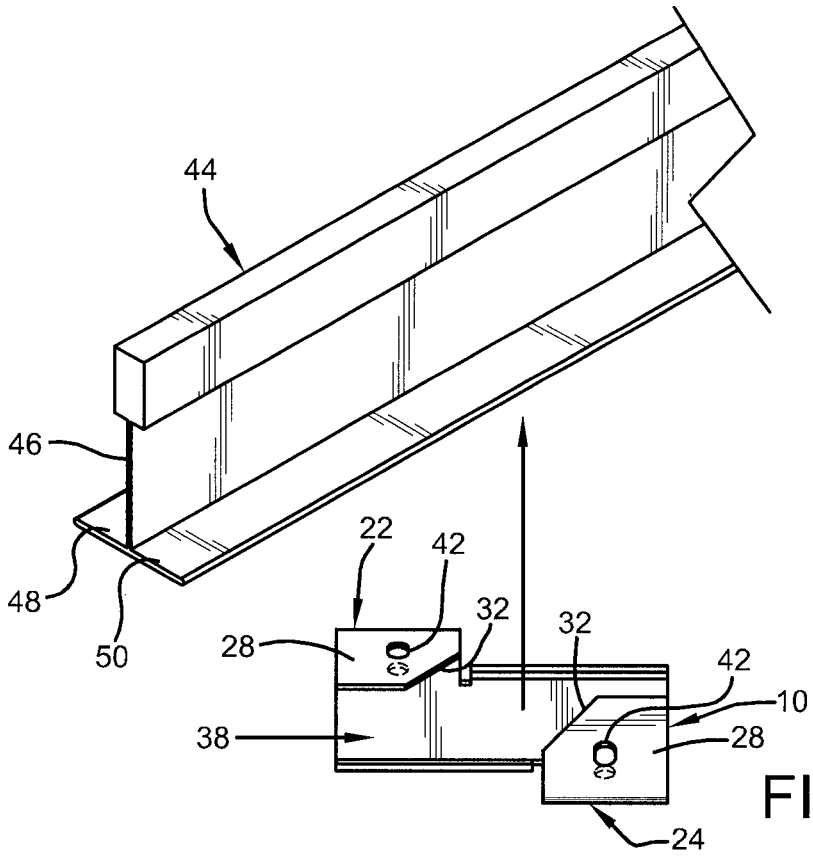
FIG. 4 is a perspective view of a ceiling clip according to the concepts of the present invention positioned adjacent to a support member of a T-grid.
Figure 5:
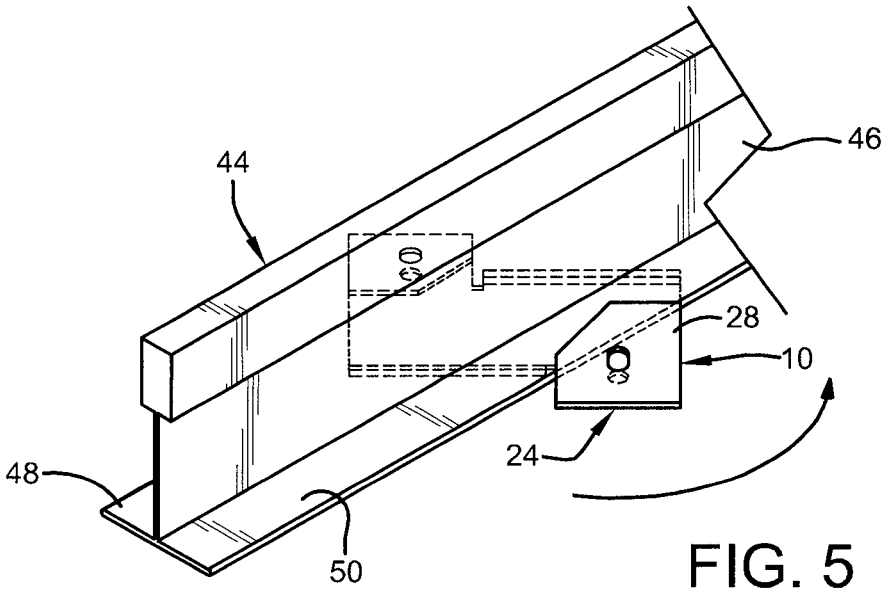
FIG. 5 is a perspective view of the ceiling clip positioned partially on the support member.

Referring now to FIGS. 4-7, the method of securing the ceiling clip 10 to a T-grid will now be described. The support members 44 of the T-grid include a generally vertical column member 46 and substantially orthogonal first and second arms 48 and 50, thereby forming the "T" shape of the support members. The ceiling clip 10 is orientated at an angle relative to the support members 44 so that the channel 38 is angled relative to the arms 48 and 50 (FIG. 4). The angled edges 32 of each of the return portions 28 creates an opening between the first and second wings 22 and 24 of sufficient size to allow the arms 48 and 50 to pass therethrough.

Figure 6:
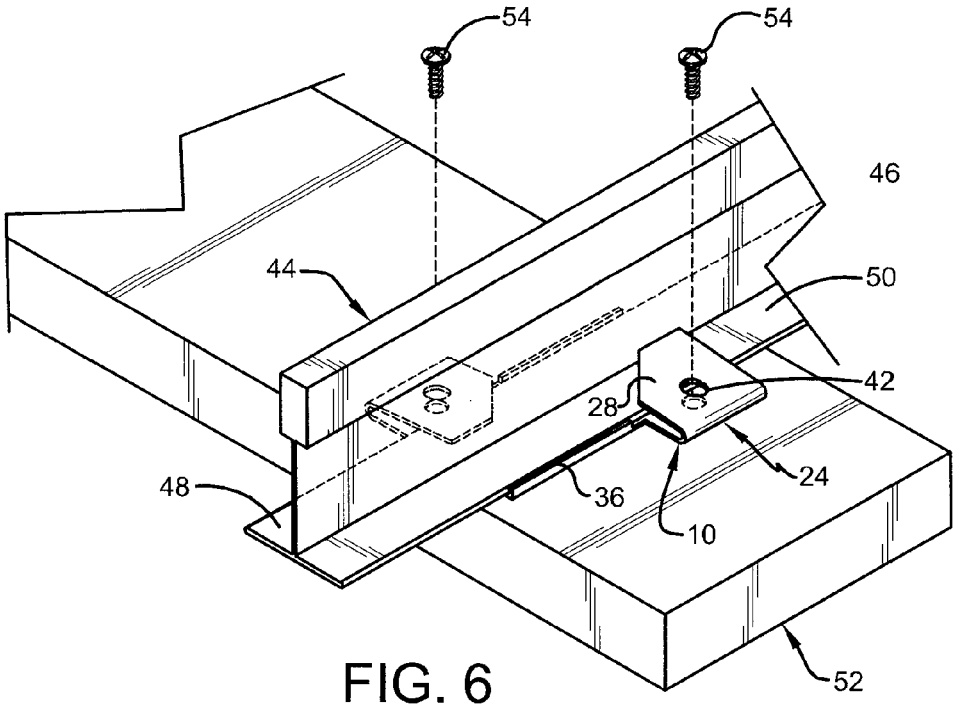
FIG. 6 is a perspective view of the ceiling clip fully positioned on the support member and adapted for attachment to a ceiling plank.

The ceiling clip 10 is then positioned adjacent the arms 48 and 50 so that the ribs 36 may be contacting a lower surface of the arms 48 and 50. The ceiling clip may then be rotated (see FIG. 5) so that each of the return portions 28 of the first and second wings 22 and 24 are positioned above the arms 48 and 50, while the base portions 26 of the first and second wings 22 and 24 are positioned below the arms 48 and 50. Once the ceiling clip 10 has been rotated so that the channel 38 is generally parallel to the arms 48 and 50, the arms will be received in the channel 38 with the ribs 36 engaging side edges of each of the arms 48 and 50 (FIG. 6). When the ceiling clip is in this position, the holes 40 and apertures 42 of the first and second wings 22 and 24 are positioned laterally outwardly of the arms 48 and 50 so that a fastener may pass therethrough without engaging either of the arms.

Figure 7:
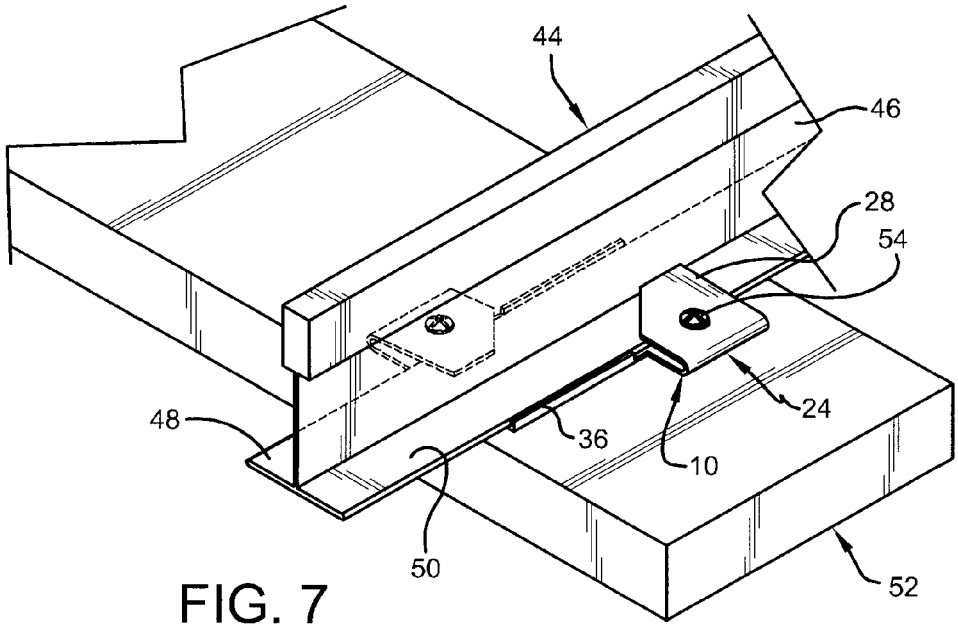
FIG. 7 is a perspective view of the ceiling clip secured to the support member and a ceiling plank.

As shown in FIGS. 6 and 7, a ceiling panel or plank 52 may be positioned below the ceiling clip 10 that is secured to the support member 44. In certain embodiments, the ceiling planks 52 may be orientated generally perpendicular to the support members 40 so as to be secured along their length at several locations. Fasteners 54, which may be screws as shown in FIGS. 1, 6 and 7, are driven through the slots 42 and holes 40 of the first and second wings 22 and 24 and into the plank 52. When tightened, the fasteners 54 cause the return portion 28 of each wing 22 and 24 to deform by bending at the elbow 30. Tightening of the fasteners 54 thus causes the first and second wings 22 and 24 to exert a clamping force upon the arms 48 and 50 to further secure the ceiling clip 10 to the support member 44.

As is apparent from the foregoing, the ceiling clip 10 as disclosed herein provides an easy and reliable mechanism for securing ceiling panels or planks to a suspended grid system. The ceiling clip 10 may be used with conventional T-grid support systems, and does not require drilling holes or driving fasteners through the support members. Furthermore, the ceiling clip 10 is completely hidden from view once the ceiling system is installed, and no holes or fasteners are visible from below.

It is thus evident that a ceiling clip and ceiling system constructed as described herein accomplishes the objects of the present invention and otherwise substantially improves the art.

What is claimed is:

1. A clip for attachment to a suspended ceiling grid support member, the clip comprising a generally planar body portion having a first edge, a second edge opposed to said first edge, a first end, a second end opposite said first end, a first wing positioned at said first edge and at said first end; and a second wing positioned at said second edge and at said second end, said first wing having spaced aligned apertures located outside of said first edge, and said second wing having spaced aligned apertures located outside of said second edge; a portion of said first wing positioned over and spaced from said planar body portion of said clip, and a portion of said second wing positioned over and spaced from said planar body portion of said clip.

2. The clip of claim 1, said first and second wings each including a base portion extending outwardly from the body portion and a return portion connected to the base portion by an elbow and extending back toward the body portion.

3. The clip of claim 2, said aligned apertures in said first and second wings including a hole in said base portion and a slot in said return portion.

4. The clip of claim 3, said slot in each of said return portions having a width approximately equal to a diameter of said hole in said base portions, and a length greater than said diameter of said holes.

5. The clip of claim 2, said base portions of said first and second wings being coplanar with said body portion.

6. The clip of claim 2, said return portion being oriented at an acute angle relative to said base portion.

7. The clip of claim 2, said return portions of said first and second wings each including an angled edge facing an interior of the body portion, the angled edges being generally parallel to one another.

8. The clip of claim 1, further comprising a notch in said first and second edges of said body portion adjacent said first and second wings.

9. The clip of claim 1, where a rib extends upwardly from each of said first and second edges of said body portion, said ribs and said body portion together forming a channel.

10. The clip of claim 1, where the clip is formed of laminated spring steel.

11. A ceiling clip comprising a generally planar body portion having a first edge, a second edge opposed to said first edge, a first end, a second end opposite said first end, a first wing positioned at said first edge and at said first end; and a second wing positioned at said second edge and at said second end, said first and second wings each including a base portion generally coplanar with said body portion and extending outwardly therefrom, a return portion connected to said base portion at an elbow and extending back toward said body portion at an acute angle relative to said base portion, said first wing having a hole in said base portion and an aligned slot in said return portion, said hole and said slot in said first wing located outside of said first edge, and said second wing having a hole in said base portion and an aligned slot in said return portion, said hole and said slot in said second wing located outside of said second edge.

12. The ceiling clip of claim 11, said slot in said first wing having a length greater than a diameter of said hole in said first wing, and said slot in said second wing having a length greater than a diameter of said hole in said second wing.

13. A ceiling system comprising support members having vertical columns and arms extending outwardly from a bottom edge of said vertical column;

at least one clip secured to each of said support members, said clip including a generally planar body portion having a first edge, a second edge opposed to said first edge, a first end, a second end opposite said first end, a first wing positioned at said first edge and at said first end; and a second wing positioned at said second edge and at said second end, said first wing having spaced aligned apertures located outside of said first edge, and said second wing having spaced aligned apertures located outside of said second edge;

a ceiling plank; and fasteners extending through said apertures in said clips and into said ceiling plank to secure said plank to said support members, said fasteners being positioned adjacent said arms of said support members without passing there through.

14. The ceiling system of claim 13, said first and second wings applying a compressive force on said arms to secure said clip to said support members.

15. The ceiling system of claim 13, said first and second wings each including a base portion extending outwardly from the body portion and positioned below said arms, and a return portion connected to the base portion by an elbow and extending back toward the body portion, said return portion positioned above said arms.

16. The ceiling system of claim 15, said aligned apertures in said first and second wings including a hole in said body portion and a slot in said return portion.

17. The ceiling system of claim 15, said return portions of said first and second wings each including an angled edge facing an interior of the body portion, the angled edges being generally parallel to one another.

18. The ceiling system of claim 13, where a rib extends upwardly from each of said first and second edges, said ribs and said body portion together forming a channel that receives said arms of said support member.

19. The ceiling system of claim 13, where a plurality of clips are secured to each of said support members.

20. The ceiling system of claim 13, where said ceiling planks extend generally perpendicularly to said support members.

* * * * *